US005368416A

United States Patent [19]

Cataldo

[11] Patent Number: 5,368,416

[45] Date of Patent: Nov. 29, 1994

[54] BUILDING COMPONENT FOR A NOISE BARRIER RETAINING WALL

[76] Inventor: Cataldo, 54545 Foss, Mt. Clement, Mich. 48042

[21] Appl. No.: 125,924

[22] Filed: Sep. 23, 1993

[51] Int. Cl.[5] ..... E02D 3/02

[52] U.S. Cl. ..... 405/285; 52/586.1; 405/258; 405/284; 405/273

[58] Field of Search ..... 405/284, 285, 286, 272–276; 52/586.1

[56] References Cited

U.S. PATENT DOCUMENTS

| | | | |
|---|---|---|---|
| D. 275,705 | 9/1984 | Gabriel . | |
| D. 296,366 | 6/1988 | Conti . | |
| D. 299,170 | 12/1988 | Meheen . | |
| 757,368 | 4/1904 | Tyuax | 405/274 |
| 800,067 | 9/1905 | Brooke . | |
| 800,674 | 10/1905 | Palmer . | |
| 1,907,135 | 5/1933 | Wemlinger et al. | 405/285 |
| 1,933,483 | 10/1933 | Pennoyer . | |
| 1,943,800 | 1/1934 | Morrison . | |
| 1,952,380 | 3/1934 | Leemann | 405/285 X |
| 2,014,778 | 9/1935 | Pedersen . | |
| 2,828,613 | 4/1958 | Wilson . | |
| 3,553,922 | 1/1971 | Moore et al. | 405/274 X |
| 4,707,962 | 11/1987 | Meheen . | |
| 5,014,476 | 5/1991 | Leslie et al. | 52/586.1 X |

FOREIGN PATENT DOCUMENTS

| | | | |
|---|---|---|---|
| 1127500 | 8/1956 | France | 405/284 |
| 0083723 | 4/1986 | Japan | 405/285 |

*Primary Examiner*—Dennis L. Taylor
*Attorney, Agent, or Firm*—Remy J. VanOphem

[57] ABSTRACT

A building component for a noise barrier retaining wall which is structurally suitable for retaining materials such as earth or wind. The building component is formed to assist in the construction of the noise barrier retaining wall, and more specifically, to support and position the wall's reinforcing posts during the construction of the wall, such that the reinforcing posts can be permanently set in suitable footings after the wall has been erected. Such a method is in contrast to prior art approaches which require that such reinforcing posts be permanently and accurately in place prior to construction of the wall. Accordingly, the time, labor and costs involved in the construction of the wall are reduced, allowing for a more economical retaining wall, while retaining the structural components necessary to ensure a properly aligned and plumb wall that exhibits suitable strength and stability.

20 Claims, 2 Drawing Sheets

BUILDING COMPONENT FOR A NOISE BARRIER RETAINING WALL

BACKGROUND OF THE INVENTION

1. FIELD OF THE INVENTION

The present invention generally relates to noise barrier retaining walls used to retain earth, water, wind, noise and other materials, and which are able to sustain the pressures applied to a retaining surface thereof by such retained materials. More specifically, this invention relates to a building component used in the construction of a retaining wall, used as a noise barrier wherein the building component is configured to minimize labor during the construction of the noise barrier retaining wall.

2. DESCRIPTION OF THE PRIOR ART

Retaining walls are conventionally used for the purpose of retaining numerous materials, including earth, grain, water or wind. Further, retainer walls are used as noise barriers especially on highways directed through an urban area. To be able to withstand the high pressures generated by the materials being retained, a retaining wall must be constructed in a manner that promotes the strength of the wall, as well as the stability of the wall in order to prevent overturning and sliding. In addition, the base of the wall must be adequately sized so as to sufficiently distribute the weight of the retaining wall so as not to exceed the safe bearing strength of the underlying supporting soil. Safety dictates that, even if the retaining wall is used as a wind or noise barrier, all of these considerations be taken into account.

To facilitate their design and construction, retaining walls are typically formed by interconnecting a number of individual partitions made of concrete or wood, with concrete being the preferred material where permanence and high strength are required. Various anchoring techniques are typically required to firmly anchor each partition, so as to promote the strength and stability of a retaining wall, as well as to distribute the weight of the wall. Examples of retaining walls constructed of individual concrete partitions include U.S. Pat. No. 4,707,962 to Meheen and U.S. Des. Pat. No. 296,366 to Conti. Meheen discloses a rather complex structure which is constructed by interconnecting partitions having various geometries. The individual partitions are interconnected to form a retaining wall having an irregular facade. Some of the partitions are generally I-shaped, having enlarged ends with a passageway formed therein for receiving a rod which anchors and stabilizes the partition. As shown, the rods are each permanently embedded in footings to secure the partitions. As such, retaining walls constructed in accordance with Meheen generally require that the rods be accurately aligned and set in place prior to stacking the partitions in order to form the wall. Accordingly, the task of establishing the proper alignment and plumb of the rods is critical to the subsequent construction of the retaining wall.

The reliance on the accurate prepositioning of rods or pilings is apparent with other retaining wall structures of the prior art. For example, U.S. Pat. No. 1,933,483 to Pennoyer teaches a retaining wall whose individual concrete wall sections are positioned intermediate steel pilings. The ends of each wall section are formed with recesses shaped to closely receive a piling, with bonding material being used to fill the recesses so as to form a water-tight retaining wall. While the accuracy of the alignment and plumb of the pilings is not as critical as that for the retaining wall taught by Meheen, the pilings must nevertheless be sufficiently plumb so as to prevent the wall from leaning. In addition, substantial deviations from the vertical can significantly complicate construction of the wall.

Similar to that taught by Pennoyer, the retaining wall taught by U.S. Pat. No. 1,943,800 to Morrison relies on pilings which are received in recesses formed in the ends of each wall partition. Again, proper alignment and setting of the pilings prior to the construction of a wall is critical to the teachings of Morrison. Morrison teaches the use of an additional piling which is received in a large central opening in each partition. Due to the relative size of the large central opening, it is apparent that the location of the partitions relative to these additional pilings is not critical to the alignment of the retaining wall. However, as taught by Morrison, these pilings are not required for the structural anchoring of the retaining wall to the substratum.

From the above discussion, it can be readily appreciated that the prior art generally teaches a method of retaining wall construction in which the assembly and plumb of the wall is heavily dependent on accurately positioning and permanently setting posts or pilings prior to the construction of the wall. The posts or pilings serve to locate the individual wall partitions during the construction of the wall, and therefore significantly determine the structural integrity of the retaining wall. However, such an approach makes the operation of locating and setting the posts or pilings a critical task in the construction of a retaining wall, which complicates and increases the labor required for the construction of the wall.

Accordingly, what is needed is a retaining wall whose construction eliminates the operation of presetting the posts or pilings by which the noise barrier retaining wall is anchored, such that a significant reduction in the time, labor and costs required during the construction of the retaining wall can be achieved. Such a noise barrier retaining wall would require that the individual wall components be specifically tailored to assist in the self-alignment of the wall with respect to the substratum on which the wall is to be built, as well as assist in the proper alignment of the components relative to each other.

SUMMARY OF THE INVENTION

According to the present invention there is provided a building component for a retaining wall used as a noise barrier which is structurally suitable for retaining earth, wind or noise. The building component is formed to assist in the construction of the noise barrier retaining wall and, more specifically, to support and position the wall's reinforcing posts during the construction of the wall, such that the reinforcing posts can be permanently set in suitable footings after the wall has been erected. Such a method is in contrast to prior art approaches which require that posts be in place and accurately set prior to construction of the wall. Accordingly, the time, labor and costs involved in the construction of the wall are reduced, allowing for a more economical retaining wall, while retaining the structural components necessary to ensure a properly aligned and plumb wall that exhibits suitable strength and stability for its intended uses.

The building component of this invention is generally an elongated member which terminates at each of its oppositely disposed ends with an interconnecting feature. The interconnecting feature is sized and shaped to receive at least a portion of a reinforcing post which is configured to anchor and stabilize the retaining wall or noise barrier with respect to the wall's underlying substratum, as well as contribute strength to the retaining wall. Associated with each interconnecting feature is a device with which the reinforcing post may be secured to the building component. A suitable device for this purpose is a plate which is secured to each interconnecting feature. The plate is formed from a weldable material so as to enable the reinforcing post to be welded to the plate, for the purpose of securing the reinforcing post to the building component during the construction of the wall. The building component is also provided with locating features formed on its upper and lower surfaces which serve to locate the building component relative to those building components which are immediately below and above the building component.

Upon abutting the ends of two building components, the interconnecting features define a cavity between the building components which extends vertically. The cavity is sized to closely receive the reinforcing post. More specifically, the cavity is sized such that the plates secured to the interconnecting features will contact the reinforcing post when received within the cavity. Contact between the plates and the reinforcing post allow the plates to be welded to the post as each tier of the retaining wall is erected. Consequently, the building components are aligned with respect to each other as the wall is erected by being aligned with their locating features on their upper and lower surfaces, as well as the reinforcing post which is received within their shared cavities.

According to a preferred aspect of this invention, during the construction of the noise barrier retaining wall, the lower ends of the reinforcing posts extend down into holes which were dug prior to placement of the first tier of building components. By securing the reinforcing posts directly to the ends of the building components, the reinforcing posts serve as a temporary alignment member for the retaining wall with respect to the individual building components. Once the retaining wall has been completed, the holes into which the reinforcing posts extend, as well as the cavities in which the reinforcing posts are received within the retaining wall, are filled with a suitable bonding material so as to form the pier footings for the retaining wall, and simultaneously set the reinforcing posts within these pier footings.

From the above, it can be seen that a significant advantage of this invention is that the reinforcing posts need not be permanently preset prior to construction of the retaining wall. As a result, the labor and time conventionally required to accurately and independently set each of the reinforcing posts is completely eliminated. Instead, the building components and the reinforcing posts cooperate to properly align each other during the construction of the retaining wall. In effect, the placement of the individual building components directly determines the alignment of the retaining wall and the placement of the reinforcing posts, contrary to prior art methods which require that the individual building components be aligned with respect to permanently set posts or pilings. In accordance with this invention, only after the retaining wall is substantially complete must the reinforcing posts be permanently set in a suitable footing to permanently establish the alignment of the retaining wall, as well as contribute the required strength and stability to the retaining wall.

Accordingly, it is an object of the present invention to provide a building component for a noise barrier retaining wall which is formed and configured to directly assist in the alignment of the retaining wall during construction.

It is a further object of the invention that the building component include an interconnecting feature at each end which can be secured to a reinforcing member during the construction of the noise barrier retaining wall, such that the reinforcing member is and remains properly aligned with respect to the ends of the building component as the retaining wall is constructed.

It is still a further object of the invention that the building component include features on its upper and lower surfaces which assist in aligning the building component with building components placed immediately below and immediately above the building component.

It is another object of the invention that the noise barrier retaining wall be constructed without the requirement to permanently set the reinforcing members prior to the erection of the retaining wall, such that reduced time, labor and costs are required in the construction of the retaining wall.

Other objects and advantages of this invention will be more apparent after a reading of the following detailed description taken in conjunction with the drawings provided.

DETAILED DESCRIPTION OF THE PREFERRED EMBODIMENT

Figure 1:
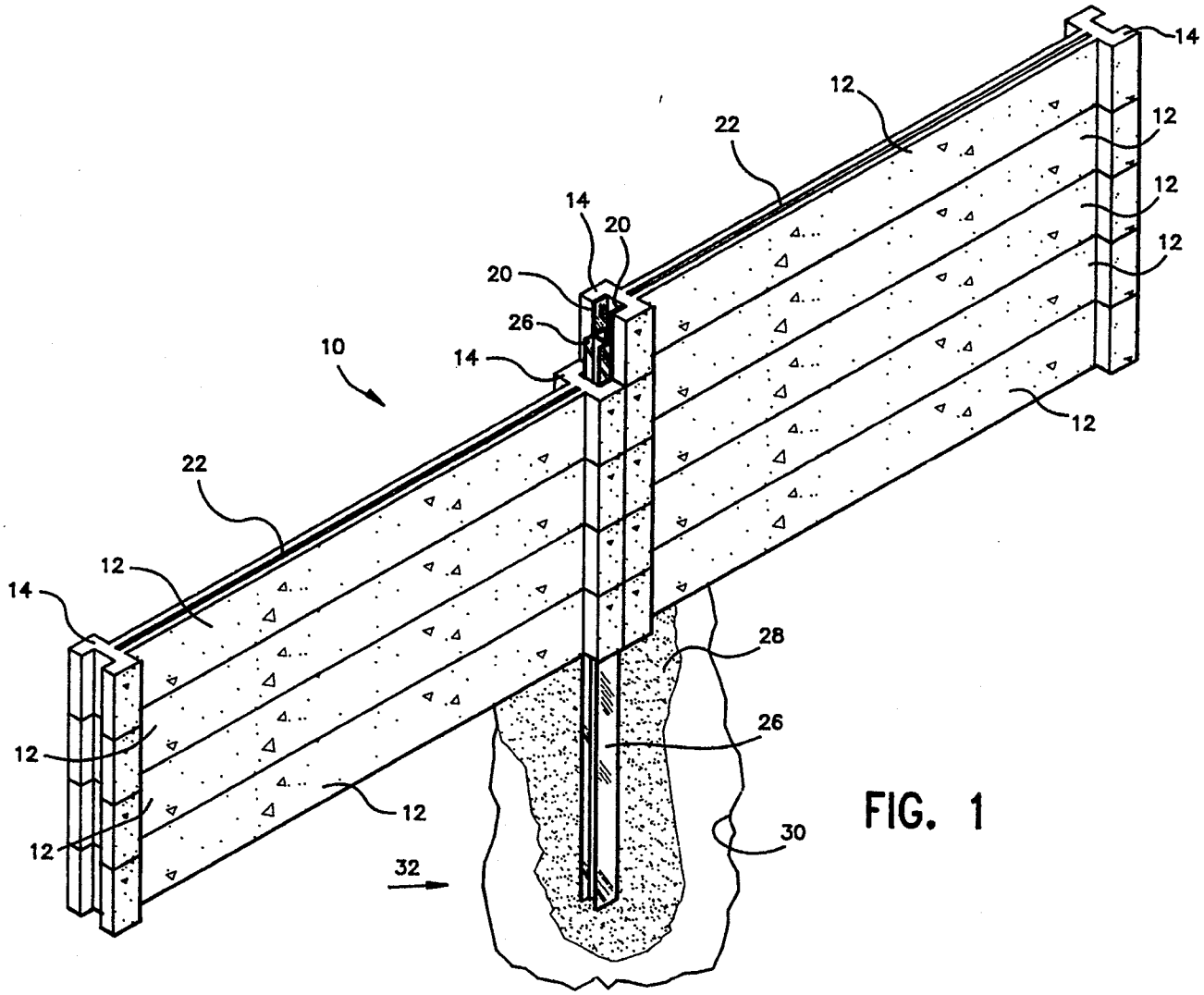
FIG. 1 is a perspective view of a noise barrier retaining wall constructed in accordance with a preferred embodiment of this invention.
Figure 2:
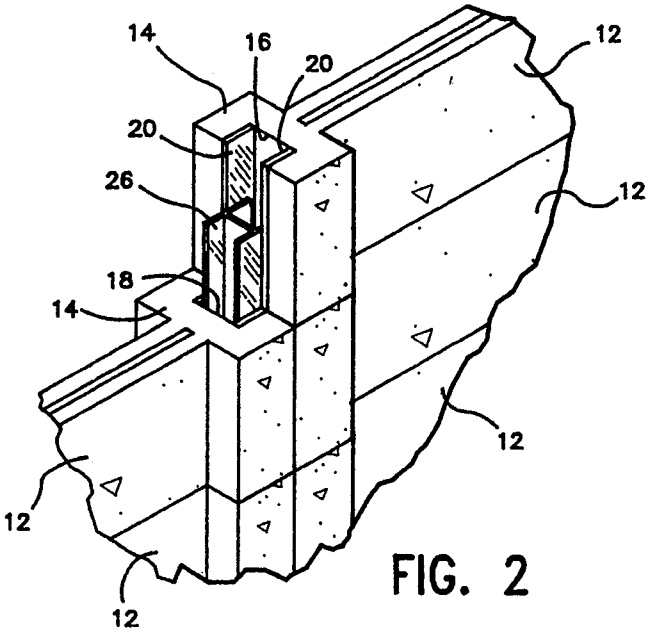
FIG. 2 is a detailed view showing a joint formed between an abutting pair of building components and a reinforcing post of the retaining wall of FIG. 1.
Figure 3:
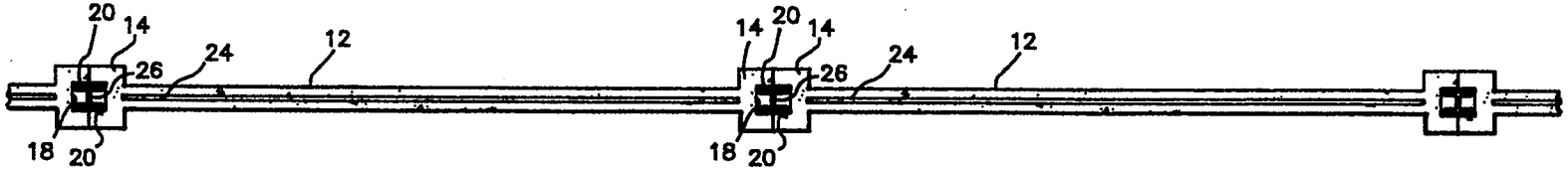
FIG. 3 is a bottom view of the retaining wall of FIG. 1.

With reference to FIGS. 1 through 3, there is shown a retaining wall or noise barrier 10 constructed in accordance with a preferred embodiment of this invention. As illustrated, the retaining wall 10 is composed of a number of individual building components 12, each of which is substantially identical to the other. As is conventional, the retaining wall 10 of this invention can be constructed to be suitable for a wide variety of applications by which earth, wind or other materials may be retained. The construction of the retaining wall 10, as well as the physical size and shape of the building components 12 and the materials used therefor, will be largely determined by the physical demands of the application, such as the pressures which will be imposed by the retained material and which must be sustained during the life of the retaining wall 10.

While the present invention is illustrated and will be described in terms of a concrete retaining wall or noise barrier 10 whose building components 12 have a preferred shape, those skilled in the art wall recognize that the advantageous features of this invention can be employed with building components 12 that may appear considerably different from that shown in the Figures.

Accordingly, the description which follows is provided only as representative of the type of construction and application for which the present invention is intended.

As seen in FIG. 1, the building components 12 are generally elongated members, meaning that the length of each building component 12 is greater than its height and width. In addition, the height of each building component 12 is preferably greater than its width, though this dimensional characteristic can be reversed when desired or if necessary. The building components 12 are illustrated as being formed from concrete, though it is foreseeable that other materials could also be used, such as treated lumber. In addition, the building components 12 are shown to have a substantially smooth and uninterrupted surface, such that the noise barrier 10 formed therewith will have a substantially planar bearing surface. Again, however, the cosmetic appearance of the building components 12 can vary considerably within the scope of this invention.

Generally, the building components 12 are characterized by having enlarged ends 14 whose widths are greater than the width of that portion of the building component 12 intermediate the enlarged ends 14. A groove 22 or another suitably recessed feature is preferably formed in the upper surface of each building component 12, while a tongue 24 (shown in FIG. 3) is formed in its lower surface. Alternatively, the placement of the groove 22 and tongue 24 on the building component 12 can be reversed, with the groove 22 being on the lower surface and the tongue 24 being on the upper surface of the building component 12. The width of the groove 22 is roughly sized to receive the width of the tongue 24, such that a degree of interlocking between building components 12 is achieved when one building component 12 is stacked upon another. As a result, the groove 22 and tongue 24 cooperate to laterally align the building components 12 during the construction of the retaining wall 10.

As shown in the Figures, a vertically-oriented channel 16 is formed in each enlarged end 14 of each building component 12. Though the channels 16 are illustrated as having a rectangular cross section, it is foreseeable that other shapes and/or contours could be employed as well. The channels 16 are disposed at the enlarged ends 14 of the building components 12, such that when two building components 12 have their respective enlarged ends 14 abutted against each other, their respective channels 16 will form a cavity 18 therebetween, as most readily seen in FIG. 3. The channels 16 are sized and shaped to receive a suitable reinforcing post 26, which extends through the entire column of building components 12 and projects into a hole 30 formed in the substratum, which will typically be soil 32. The reinforcing post 26 can be of any suitably rigid material, though a relatively corrosion-resistant steel is preferred. Furthermore, though the reinforcing post 26 is shown to have a cross section similar to that of an I-beam, other forms are possible. Finally, and in accordance with the preferred embodiment of this invention, weldability is also a necessary characteristic for the reinforcing post 26, as will be described below.

With reference to FIG. 2, a pair of plates 20 are shown as being secured to opposing walls of each channel 16. The plates 20 are preferably integrally cast with the building components 12, though it is foreseeable that the plates 20 may be secured to their respective channel 16 by other suitable methods, such as with fasteners. The plates 20 are positioned within the channels 16 such that, when the reinforcing post 26 is received within the cavity 18, at least a portion of each plate 20 will be in close proximity to the reinforcing post 26. More specifically, once assembled, the plates 20 and reinforcing post 26 should be sufficiently close to allow them to be welded together during the construction of the noise barrier retaining wall 10.

Though the preferred embodiment of this invention involves welding each plate 20 to its respective reinforcing post 26, those skilled in the art will recognize that numerous methods and techniques are available by which the reinforcing post 26 can be temporarily or permanently secured within the channels 16 formed in the building components 12. Therefore, though the above description of the preferred embodiment specifically involves welding the reinforcing post 26 to a plate 20 secured to the enlarged end 14 of the building component 12, the teachings of the present invention are not to be interpreted as being limited to such a technique or embodiment.

While the above description of the preferred embodiment generally serves to identify the structural features of the noise barrier 10 and its individual building components 12, a better understanding of the features and advantages of the present invention can be acquired through the discussion below, which describes a preferred method by which the noise barrier retaining wall 10 is constructed.

Generally, prior to construction of the retaining wall 10, the surface of the soil 32 on which the noise barrier retaining wall 10 is to be built must be adequately tested and prepared in accordance with conventional practices. In addition, the approximate sites at where reinforcing posts 26 are to be positioned must be identified, with a suitable hole 30 being dug for each reinforcing post 26, each being spaced apart from its neighbor in order to correspond with the lengths of the building components 12 being used. As is conventional, the depths of the holes 30 will be dependent in part on the type of soil 32 on which the retaining wall 10 is being built. The depths of the holes 30, in conjunction with the desired height of the noise barrier retaining wall 10, will determine the lengths of the reinforcing posts 26 required.

The base of the noise barrier retaining wall 10 is then established by placing one or more building components 12 between the holes 30, such that each of their respective enlarged ends 14 extends over a corresponding hole 30, as suggested by FIG. 1. Each building component 12 is aligned and abutted with its adjacent building component 12, as also shown in FIG. 1. By abutting the enlarged ends 14 of the building components 12, their respective channels 16 form the cavity 18 described above. The reinforcing post 26 can then be slid through the cavity 18 until its lower end rests on the bottom of the hole 30.

Upon confirming the proper alignment of the building components 12 with each other as well as with the vertical, the plates 20 cast into the walls of the channels 16 can be welded directly to the reinforcing post 26. In that the weld joint formed by this operation is required only to temporarily align the reinforcing post 26 with the building components 12, a tack weld will typically be suitable, though a more thorough weld may be preferable under some circumstances. Thereafter, a second tier of building components 12 can be placed on the first tier of building components 12. The second tier will be aligned laterally with the lower tier by engaging the tongues 24 formed in the upper building components 12 with the grooves 22 of the lower building components. Longitudinal alignment is achieved by aligning the enlarged ends 14 of the building components 12, such that the cavity 18 formed by the channels 16 is substantially uniform in the vertical direction. With each additional tier of building components 12, another welding operation is performed to weld the reinforcing post 26 to the next set of plates 20, such that the orientation of the reinforcing post 26 relative to the hole 30 and the underlying soil 32 is dictated by the alignment of the building components 12.

The above steps can be repeated until the desired height of the noise barrier retaining wall 10 is attained, as long as the retaining wall 10 does not exceed the stress limits of the soil 32. At this time, the reinforcing posts 26 may be permanently set in their respective holes 30 by filling the holes 30 with a suitable bonding material to form a pier footing 28 for the retaining wall 10. The bonding material most often used is a cement-containing material such as concrete or mortar. The concrete can be introduced down through the cavity 18 to fill both the hole 30 and the cavity 18. Alternatively, the concrete can be introduced through a portion of the hole 30 which is not covered by the enlarged ends 14 of the building components 12, in addition to being poured in through the cavity 18 from above. Another alternative is to fill the cavity 18 with a bonding material different from that used to fill the hole 30. Once the bonding material has cured, the reinforcing posts 26 will each be permanently set within their corresponding pier footings 28 for the purpose of anchoring the retaining wall 10 and contributing stability and strength to the retaining wall 10.

From the above, it can be seen that a significant advantage of the building component 12 of the present invention is that during the construction of the noise barrier retaining wall 10, the reinforcing posts 26 are not permanently preset prior to the construction of the retaining wall 10, but are instead supported and aligned relative to their respective holes 30 by the building components 12. More specifically, by securing the reinforcing posts 26 directly to the plates 20 provided at the enlarged ends 14 of the building components 12, the reinforcing posts 26 serve only as a temporary alignment member for the retaining wall 10 with respect to the individual building components 12. Generally, it is more accurate to say that the building components 12 align and support the reinforcing posts 26 during construction of the noise barrier retaining wall 10. However, once the noise barrier retaining wall 10 has been completed, the reinforcing posts 26 can be permanently set within their respective holes 30 to provide the anchoring and stabilizing functions required of conventional posts or pilings used in the construction of prior art retaining walls.

In essence, the operation of filling the cavity 18 and the hole 30 with the bonding material simultaneously forms the pier footings 28 for the noise barrier retaining wall 10, as well as permanently aligns and sets the reinforcing posts 26 for the purpose of anchoring the retaining wall 10. Furthermore, it is the bonding material which fills the cavity 18 that primarily and permanently serves to maintain the alignment of the building components 12 relative to the reinforcing posts 26. Consequently, the welds formed between the plates 20 and the reinforcing posts 26 need only be sufficient to maintain alignment during the construction of the retaining wall 10.

As a result of the above advantages, and in contrast to the prior art, the time, labor and costs conventionally required to individually position and permanently set the reinforcing posts 26 is completely eliminated. Instead, assembly of the building components 12 during the construction of the noise barrier retaining wall 10 simultaneously serves to properly align the reinforcing posts 26. In effect, the individual building components 12 directly determine the alignment of the retaining wall 10, contrary to prior art methods which rely on independently, accurately and permanently aligning a number of posts or pilings prior to the construction of the retaining wall. In accordance with this invention, only after the noise barrier retaining wall 10 is substantially complete are the reinforcing posts 26 permanently set in the pier footing 28 to permanently establish the alignment of the retaining wall 10, as well as contribute the required strength and stability to the retaining wall 10.

While the invention has been described in terms of a preferred embodiment, it is apparent that other forms could be adopted by one skilled in the art. For example, other materials could be used to form and construct the noise barrier retaining wall, various shapes and sizes for the building components could be used, and the steps described for the construction of the retaining wall could be altered while still realizing the specific advantages of this invention. In addition, fastening methods other than the weld operation described could be used to temporarily secure the reinforcing posts to the ends of the building components. Generally, any manner by which the reinforcing posts could be temporarily secured to the building components could foreseeably be employed, in that the reinforcing posts are permanently aligned within the cavity and joined to the building components with a suitable bonding agent. Accordingly, the scope of the invention is to be limited only by the following claims.

What is claimed is:

1. A building component for a retaining wall which is anchored to a substratum with reinforcing members that serve to interconnect said building component with at least second and third building components, said second and third building components being substantially identical to said building component, said building component comprising:

an intermediate portion having a first surface, an oppositely disposed second surface, and an oppositely disposed pair of ends;

an interconnecting feature formed at each of said pair of ends for receiving at least a portion of one of said reinforcing members;

means disposed at each of said interconnecting features for securing said one of said reinforcing members to said building component during the construction of said retaining wall so as to substantially align said one of said reinforcing members with respect to said building component;

means formed on said first surface of said intermediate portion for receiving a first portion of said second building component when said first surface is abutted by said second building component; and means formed on said second surface of said intermediate portion for engaging a second portion of said third building component when said second surface is abutted by said third building component;

whereby said securing means serves to position and align said one of said reinforcing members relative to said building component and relative to said retaining wall substantially throughout the construction of said retaining wall, so as to substantially eliminate a requirement to independently and permanently align and set said reinforcing members in said substratum prior to the construction of said retaining wall.

2. The building component of claim 1 wherein said interconnecting features each comprise a channel which defines approximately half of a cavity formed when one of said interconnecting features is mated with a second interconnecting feature formed on a fourth building component, said cavity being sized to receive said one of said reinforcing members.

3. The building component of claim 1 wherein said receiving means is an elongated groove formed in an upper surface of said intermediate portion.

4. The building component of claim 1 wherein said engaging means is a tongue formed in a lower surface of said intermediate portion.

5. The building component of claim 1 wherein said intermediate portion has a substantially rectangular cross-section, such that a width of said intermediate portion is less than a height of said intermediate portion.

6. The building component of claim 1 wherein said securing means comprises at least one plate which defines a channel in said interconnecting feature.

7. A building component for a retaining wall which is constructed by interconnecting said building component with a plurality of said building components, adapted to be attached to securing means at the time of assembly said building component comprising:

an intermediate portion having an upper surface, a lower surface, and an oppositely disposed pair of ends;

a channel having oppositely disposed confronting surfaces formed in each of said pair of ends;

a plate integrally cast in each of said oppositely disposed confronting surfaces of said channel, said plate being formed from a weldable material adapted to be fixed to said securing means;

means formed on said upper surface of said intermediate portion for receiving a first portion of a first building component of said plurality of building components when said building component supports said first building component; and means formed on said lower surface of said intermediate portion for engaging a second portion of a second of said plurality of building components when said building component is supported by said second of said plurality of building components.

8. The building component of claim 7 wherein said channel defines approximately half of a cavity formed when said channel mates with a second channel formed on a third of said plurality of building components, said cavity being sized to receive means for anchoring said retaining wall.

9. The building component of claim 7 wherein said receiving means is an elongated groove formed in said upper surface of said intermediate portion.

10. The building component of claim 7 wherein said engaging means is a tongue formed in said lower surface of said intermediate portion.

11. The building component of claim 7 wherein said intermediate portion has a width which is less than a height of said intermediate portion.

12. The building component of claim 7 wherein said building component is formed from a cement-containing composition.

13. A retaining wall supported on a substratum, said retaining wall comprising:

a plurality of building components, each of said plurality of building components comprising:

an intermediate portion having a first surface, a second surface oppositely disposed from said first surface, and an oppositely disposed pair of ends;

an interconnecting feature formed at each of said pair of ends; and a plate integrally cast in said interconnecting feature so as to form an exposed wall of said interconnecting feature, said plate being formed from a weldable material;

a cavity defined between an abutting pair of said interconnecting features of a first building component of said plurality of building components and a second building component of said plurality of building components;

a reinforcing member disposed within said cavity, said reinforcing member being welded to each of said plates of said first and second building components; and means contained within said cavity for permanently aligning said reinforcing member within said cavity and permanently securing said reinforcing member to said first and second building components.

14. The retaining wall of claim 13 wherein a lower end of said reinforcing member is anchored in said substratum so as to stabilize said retaining wall.

15. The retaining wall of claim 13 further comprising an elongated groove formed in an upper surface of said intermediate portion of each said building component of said plurality of building components.

16. The retaining wall of claim 13 further comprising a tongue formed in a lower surface of said intermediate portion of each said building component of said plurality of building components.

17. The retaining wall of claim 13 wherein said intermediate portion has a substantially rectangular cross section, such that a width of said intermediate portion is less than a height of said intermediate portion.

18. The retaining wall of claim 13 further comprising a second plate which is oppositely disposed from said plate, such that said cavity is substantially C-shaped so as to have a substantially rectangular cross section.

19. The retaining wall of claim 13 wherein said aligning means comprises a filler material contained within said cavity.

20. The retaining wall of claim 13 wherein said substratum comprises a concrete pier footing.

* * * * *